US005309578A

United States Patent [19]

Temple, Sr.

[11] Patent Number: 5,309,578

[45] Date of Patent: May 10, 1994

[54] DEER STAND URINAL DEVICE

[76] Inventor: Richard A. Temple, Sr., 501 German Town Rd., Minden, La. 71055

[21] Appl. No.: 58,147

[22] Filed: May 10, 1993

[51] Int. Cl.[5] ..... A47K 11/12

[52] U.S. Cl. ..... 4/144.3; 4/144.1; 221/265

[58] Field of Search ..... 4/144.1, 144.3, 144.2; 221/264, 265, 185

[56] References Cited

U.S. PATENT DOCUMENTS 2,358,850 9/1944 Chenault ..... 4/144.1
3,471,870 10/1969 Segal ..... 4/144.1 X
4,164,795 8/1979 Johnson ..... 4/144.1
4,270,231 6/1981 Zint ..... 4/144.1
4,422,188 12/1983 Strutton et al. ..... 4/144.1 X

*Primary Examiner*—Robert M. Fetsuga
*Attorney, Agent, or Firm*—Leon Gilden

[57] ABSTRACT

A rigid container having a cushioned outer layer includes a fluid tube directed into a front wall of the container canted towards the floor, wherein the fluid tube is baffled, having a vent directed towards the top wall of the container. A modification of the invention includes chlorine tablet dispensing structure for effecting bacterial control within the container structure, as well as a flush-out conduit therefore.

4 Claims, 4 Drawing Sheets

DEER STAND URINAL DEVICE

BACKGROUND OF THE INVENTION

1. Field of the Invention

The field of invention relates to deer stand apparatus, and more particularly pertains to a new and improved deer stand urinal device wherein the same is directed to the construction of a portable urinal structure for use in a deer hunting environment.

2. Description of the Prior Art

Various portable urinal structure is indicated in the prior art, such as exemplified by the U.S. Pat. Nos. 3,703,731; 4,091,476; and 4,270,231.

The instant invention attempts to overcome deficiencies of the prior art wherein the portable urinal structure of the instant invention is directed to the muffling of sounds associated with a urinary function, particularly by hunters when positioned within a deer stand. The use of the instant invention prevents the associated noise directed to the urinary process, as well as the deer becoming aware of the presence of a human and in this respect, the present invention substantially fulfills this need.

SUMMARY OF THE INVENTION

In view of the foregoing disadvantages inherent in the known types of portable urinal structure now present in the prior art, the present invention provides a deer stand urinal device wherein the same is directed to the portable and sound muffling construction of a portable urinal arrangement. As such, the general purpose of the present invention, which will be described subsequently in greater detail, is to provide a new and improved deer stand urinal device which has all the advantages of the prior art portable urinal apparatus and none of the disadvantages.

To attain this, the present invention provides a rigid container having a cushioned outer layer including a fluid tube directed into a front wall of the container canted towards the floor, wherein the fluid tube is baffled, having a vent directed towards the top wall of the container. A modification of the invention includes chlorine tablet dispensing structure for effecting bacterial control within the container structure, as well as a flush-out conduit therefore.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved deer stand urinal device which has all the advantages of the prior art portable urinal apparatus and none of the disadvantages.

It is another object of the present invention to provide a new and improved deer stand urinal device which may be easily and efficiently manufactured and marketed.

It is a further object of the present invention to provide a new and improved deer stand urinal device which is of a durable and reliable construction.

An even further object of the present invention is to provide a new and improved deer stand urinal device which is susceptible of a low cost of manufacture with regard to both materials and labor, and which accordingly is then susceptible of low prices of sale to the consuming public, thereby making such deer stand urinal devices economically available to the buying public.

Still yet another object of the present invention is to provide a new and improved deer stand urinal device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
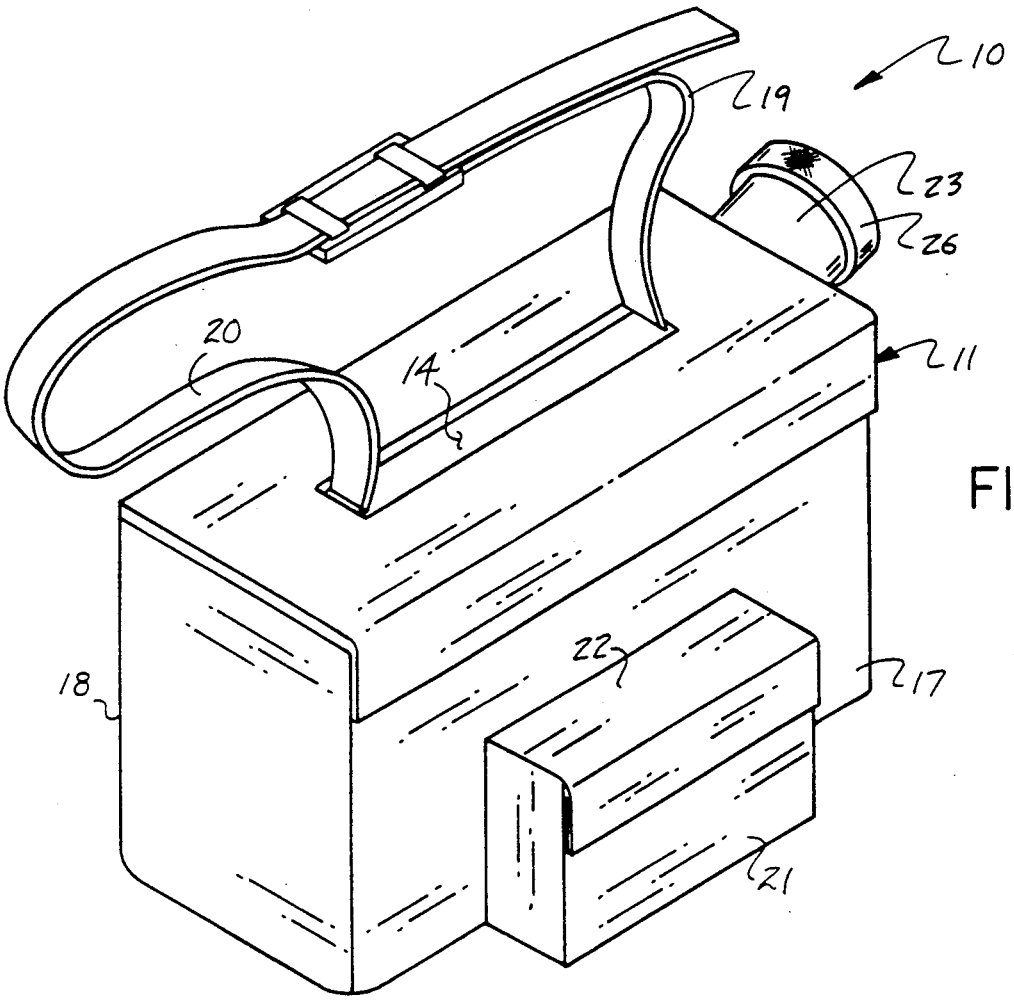
FIG. 1 is an isometric illustration of the invention.
Figure 2:
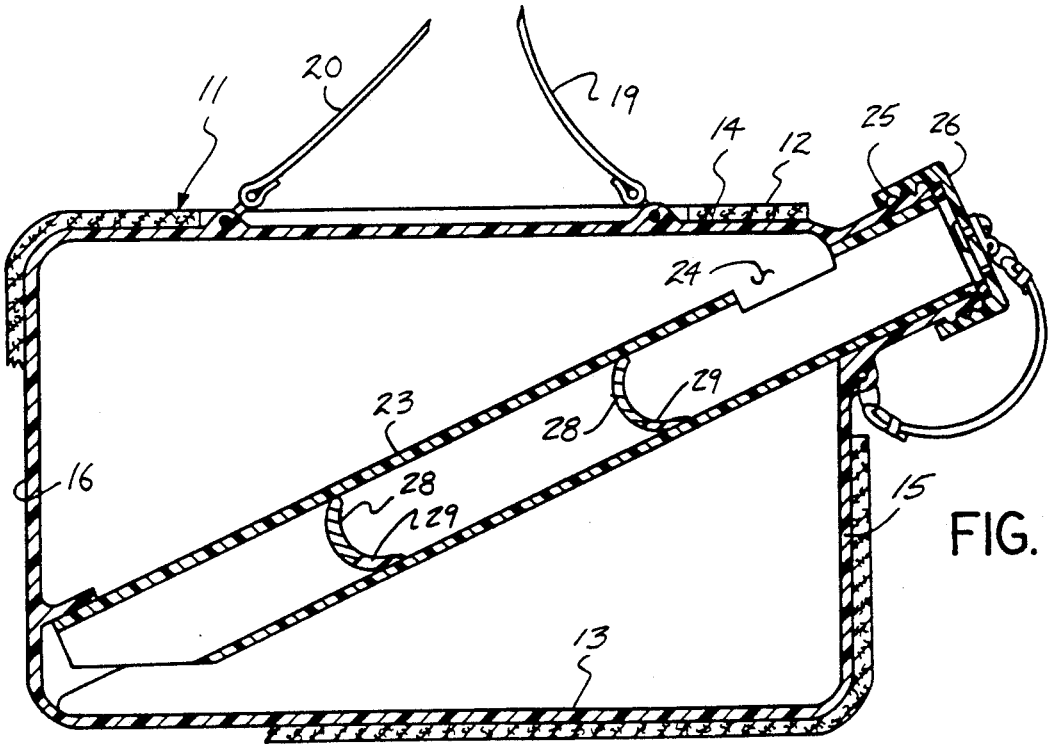
FIG. 2 is an orthographic cross-sectional illustration of the invention, as indicated in FIG. 1.
Figure 3:
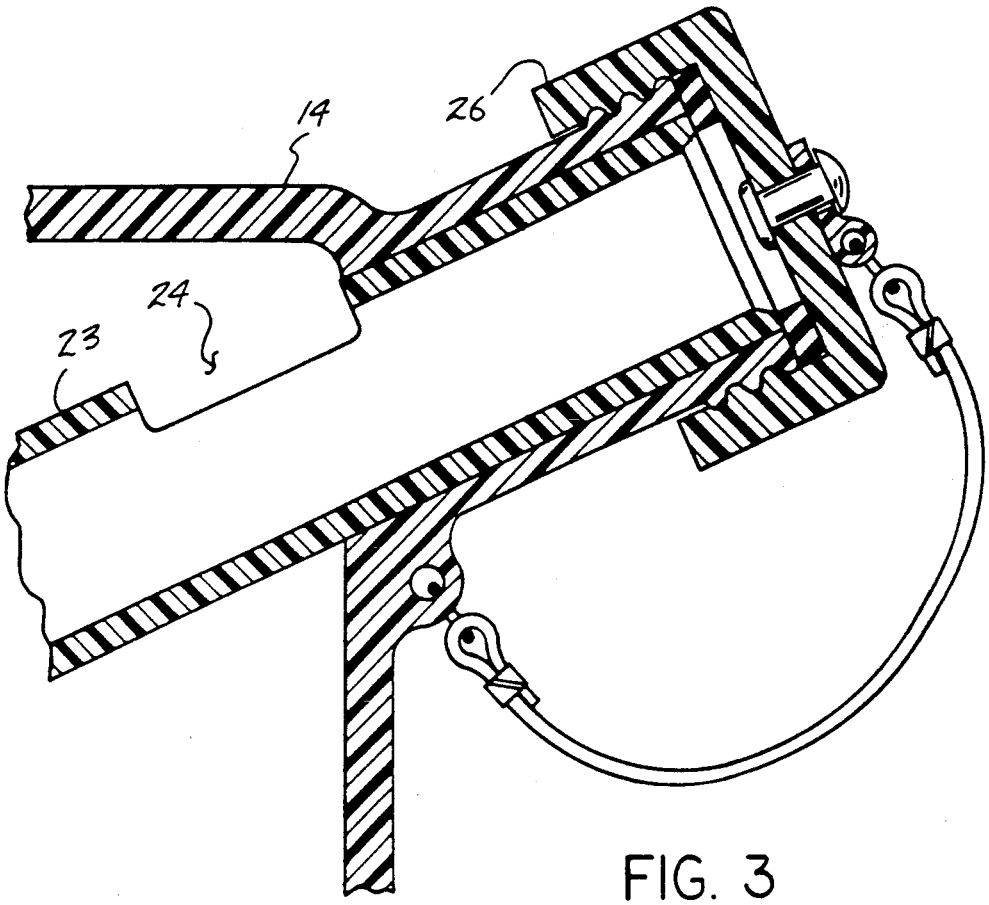
FIG. 3 is an enlarged orthographic illustration of the fluid tube and associated cap structure.

With reference now to the drawings, and in particular to FIGS. 1 to 8 thereof, a new and improved deer stand urinal device embodying the principles and concepts of the present invention and generally designated by the reference numeral 10 will be described.

More specifically, the deer stand urinal device 10 of the instant invention essentially comprises a rigid container 11 having a cushioned outer layer 12 coextensive with the container to effect sound muffling within the container structure. The container includes a container bottom wall 13 spaced from a container top wall 14, a container front wall 15 spaced from a container rear wall 16, and a container first side wall 17 spaced from a container second side wall 18. Respective first and second support straps 19 and 20 are mounted in a spaced relationship relative to the top wall 14 secured together by a buckle structure. A pouch 21 mounted to the first side wall 17 is arranged to include a cover lid 22, wherein the pouch is arranged to position chlorine tablets and the like therewithin for use in deodorizing within the container and access thereto by the cover lid 22. A fluid tube 23 projecting exteriorly of the front wall 15 adjacent an intersection with the top wall 14 extends downwardly towards the rear wall 16 directed in spaced adjacency to the bottom wall 13. The fluid tube includes a vent opening 24 adjacent the front wall in a facing relationship relative to the top wall for venting within the fluid tube, with an externally threaded free end 25 positioned exteriorly of the container structure arranged for threadedly receiving a cap member 26, that in turn is secured by a tether line to the front wall 15. An outlet opening of the fluid tube 23 is oriented in a facing relationship relative to the bottom wall 13 adjacent the rear wall 16. A plurality of arcuate baffles 28 are indicated for slowing fluid within the tube structure 23 to assist in the limiting of sound produced therewithin during use of the organization, such that each of the baffles includes at least one fluid aperture 29, with each of the baffle apertures 29 positioned towards the bottom wall 13 permitting fluid flow through the baffles but slowing fluid flow through the tube structure.

Figure 4:
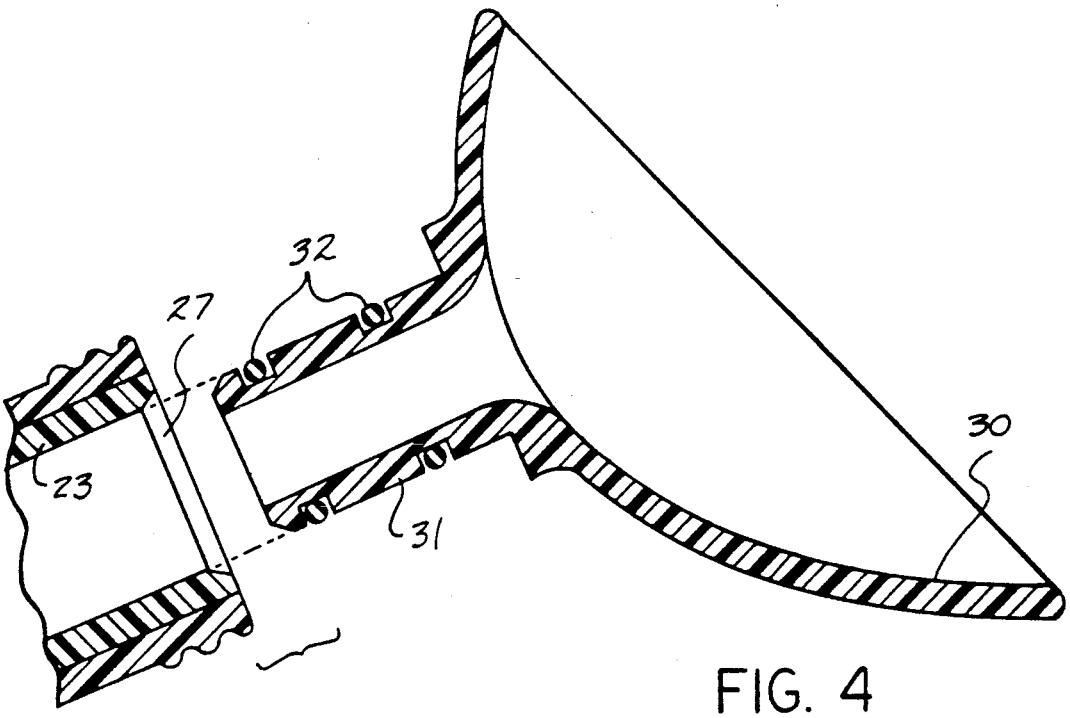
FIG. 4 is an accessory funnel member arranged for reception within the fluid conduit.

The FIG. 4 indicates the use of an accessory funnel member 30 optionally employed by the invention, having a funnel neck 31. The funnel neck 31 employs a plurality of annular sealing rings 32 spaced along the neck for sealing within the fluid tube 23 when the funnel neck 37 is directed into the fluid tube outlet opening 27. Further, the outlet opening 27 is of a generally conical configuration to assist in projection of the funnel neck 31 within the fluid tube structure 23.

Figure 5:
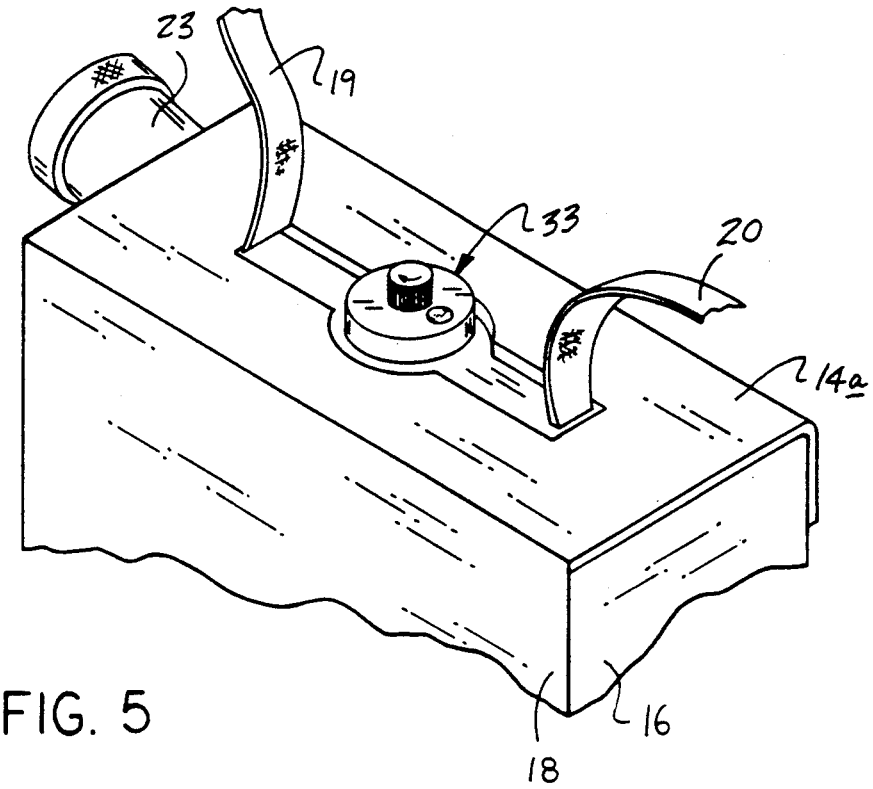
FIG. 5 is an isometric illustration of a modified top wall of the container.
Figure 6:
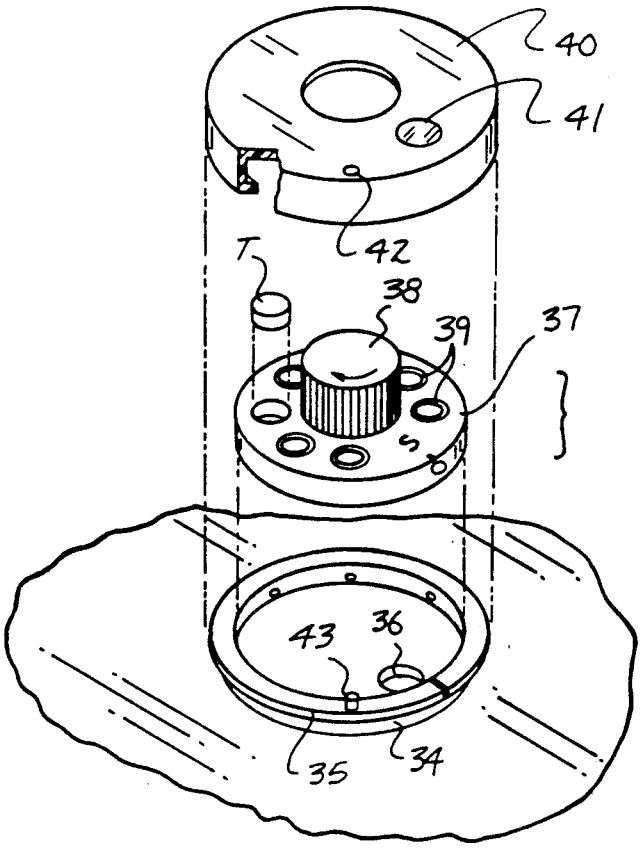
FIG. 6 is an enlarged isometric illustration of the dispensing structure indicated in an exploded view.

The FIGS. 5 and 6 indicates the use of a chlorine tablet dispenser 33 mounted to a modified top wall 14*a*, that includes a cylindrical tube 34 oriented between the first and second support straps 19 and 20, with the cylindrical tube 34 having an annular flange 35. A dispensing aperture 36 is directed through the top wall within the cylindrical tube 34 adjacent the cylindrical tube. A cylindrical hub 37 is rotatably mounted within the cylindrical tube, with the cylindrical hub having a cylindrical hub handle 38 coaxially thereof. An annular array of hub bores 39 concentric with the cylindrical hub 37 are selectively aligned individually with the dispensing aperture 36, as each of the hub bores 39 is arranged to receive a chlorine tablet "T" therewithin, in a manner as indicated in FIG. 6, such that upon alignment with one of the hub bores 39 with the dispensing aperture 36 directs the tablet "T" within the container structure for a sanitizing effect. A resilient cover cap 40 is secured about the annular flange 35, with the cover cap 40 including a cap top wall having a transparent window 41 aligned with the dispensing aperture 36 to view whether a chlorine tablet has been properly dispensed within the container structure. To this end, a cover cap registration bore 42 receives a flange rod 43 fixedly mounted to the annular flange 35 to fixedly position the cover cap relative to the annular flange.

Figure 7:
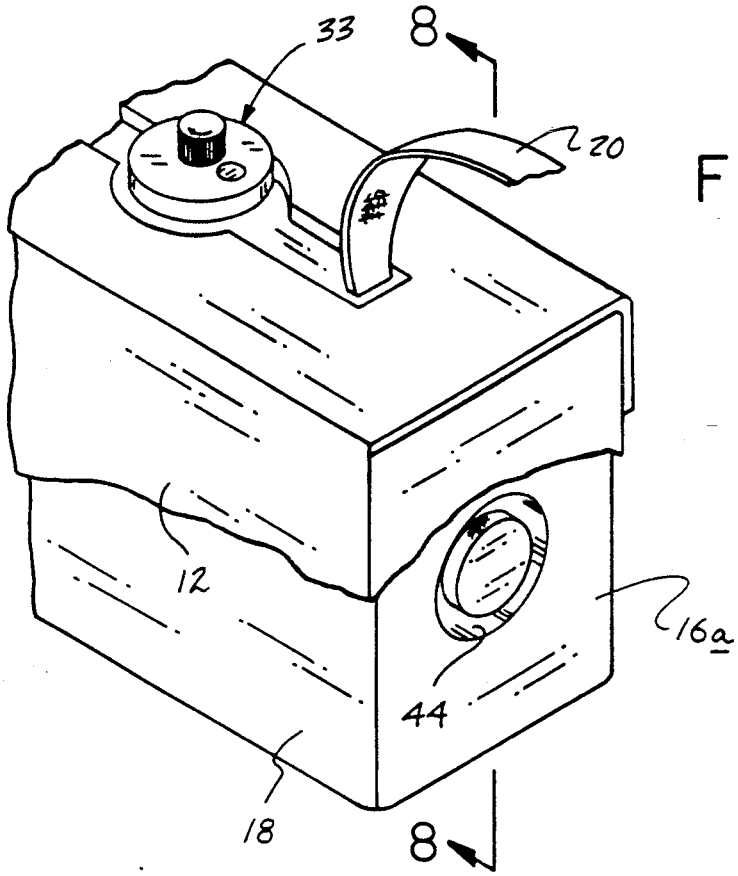
FIG. 7 is an orthographic view of a flush-out connection mounted to the rear wall of the container.
Figure 8:
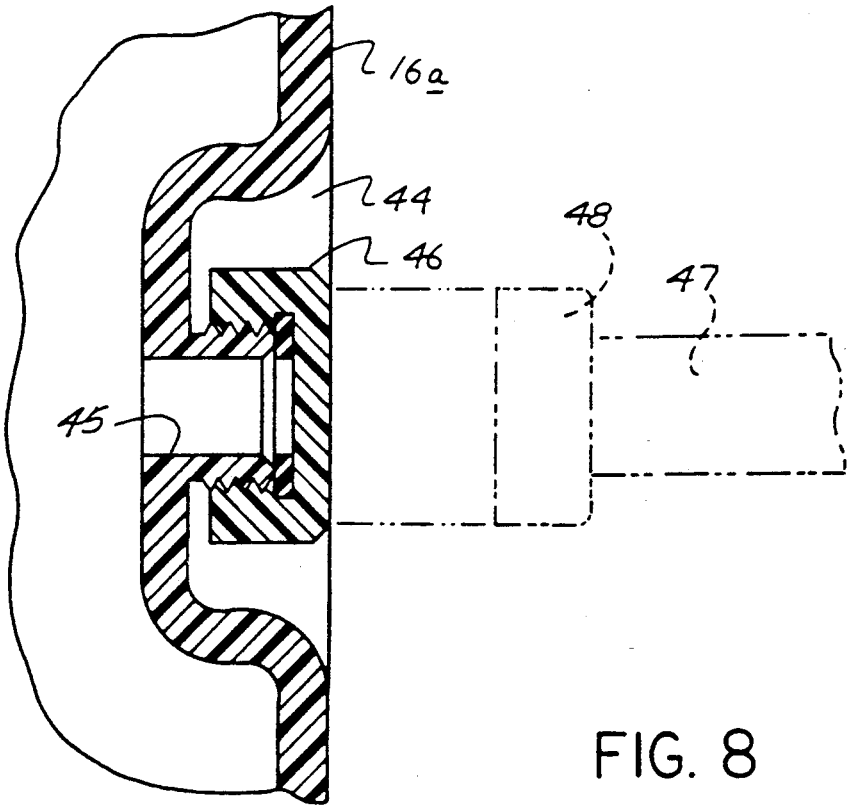
FIG. 8 is an orthographic view, taken along the lines 8—8 of FIG. 7 in the direction indicated by the arrows.

The FIGS. 7 and 8 indicates the use of a modified rear wall 16*a* having a rear wall recess 44, with an externally threaded flush-out conduit 45 projecting from the rear wall recess positioned within the recess not projecting beyond the rear wall, such that the flush-out conduit 45 includes a flush-out conduit cap 46 removably mounted therefrom, wherein a fluid hose 47 having a fluid hose coupling 48 is arranged for securement to the flush-out conduit externally threaded portion permitting a flush-out unit utilizing a conventional garden hose and the like of the container structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the Unites States is as follows:

1. A deer stand urinal device, comprising, a rigid container, the rigid container having a bottom wall, a top wall, a front wall, a rear wall, a first side wall, and a second side wall, with the container including a cushioned outer layer substantially coextensive with the rigid container, and a fluid tube directed through the rigid container extending from the rear wall in adjacency to the bottom wall and projecting through the front wall in adjacency to the top wall, wherein the fluid tube includes a free end positioned in a spaced relationship relative to the front wall, and the fluid tube having a fluid tube outlet opening within the rigid container, with the outlet opening in a facing relationship relative to the bottom wall, the free end including a cap member securably and removably mounted relative to the free end, and the fluid tube includes at least one arcuate baffle member, the arcuate baffle member having at least one fluid aperture directed through the arcuate baffle member in a lowermost end of the arcuate baffle member, and the arcuate baffle member including a concave interior wall in a facing relationship to the free end, and a funnel member, the funnel member including a funnel neck, the funnel neck having a plurality of annular sealing rings arranged to sealing engage the fluid tube within the fluid tube in a fluid sealing relationship, with the free end having a truncated conical entrance for reception of the funnel neck, and a chlorine tablet dispenser mounted to the top wall, with the dispenser having a cylindrical tube fixedly mounted to the top wall, the cylindrical tube including an annular flange directed exteriorly of the cylindrical tube, and a dispensing aperture directed through the top wall within the cylindrical tube in adjacency to the cylindrical tube, and a cylindrical hub rotatably mounted within the cylindrical tube, the cylindrical hub including a handle oriented medially of the hub, and an annular array of hub bores concentric with the cylindrical hub, with each of said hub bores arranged for selective alignment with the dispensing aperture, and each of the hub bores arranged to receive a chlorine tablet therewithin.

2. A urinal device as set forth in claim 1 including a resilient cover cap, the cover cap including a cover cap top wall, and the cover cap top wall having a transparent window, with the transparent window aligned with the dispensing aperture.

3. A urinal device as set forth in claim 2 wherein the cover cap includes a cover cap registration bore, the annular flange includes a flange rod, with the flange rod received within the registration bore to maintain alignment of the cover cap relative to the cylindrical tube.

4. A urinal device as set forth in claim 3 wherein the rear wall includes a recess, and the recess includes a flush-out conduit having an externally threaded portion, with a flush-out conduit cap removably mounted relative to the flush-out conduit about the externally threaded portion, with the flush-out conduit arranged to receive a fluid hose in fluid communication with the flush out conduit to permit fluid flushing and rinsing within the rigid container.

* * * * *